US010465359B2

(12) United States Patent
Worth

(10) Patent No.: US 10,465,359 B2
(45) Date of Patent: Nov. 5, 2019

(54) IMPLEMENT SYSTEM WITH NESTING BUCKET AND IMPLEMENT SYSTEM OPERATING METHOD

(71) Applicant: Caterpillar Inc., Peoria, IL (US)

(72) Inventor: David Worth, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/172,508

(22) Filed: Jun. 3, 2016

(65) Prior Publication Data

US 2017/0350091 A1 Dec. 7, 2017

(51) Int. Cl.
*E02F 3/40* (2006.01)
*E02F 3/34* (2006.01)

(52) U.S. Cl.
CPC ..... *E02F 3/40* (2013.01); *E02F 3/3405* (2013.01); *E02F 3/3411* (2013.01); *E02F 3/3417* (2013.01); *E02F 3/402* (2013.01)

(58) Field of Classification Search
CPC ..... E02F 3/141; E02F 3/28; E02F 3/40
USPC ..... 37/444
See application file for complete search history.

(56) References Cited

U.S. PATENT DOCUMENTS 2,864,184 A 12/1958 Fohr
3,109,248 A * 11/1963 Vos ..... E02F 3/40 37/408
4,204,349 A 5/1980 Tallis
4,274,797 A * 6/1981 Coon ..... E02F 3/303 414/694
4,454,666 A 6/1984 Gurries
4,467,539 A 8/1984 Gurries
5,815,959 A * 10/1998 Bahner ..... E02F 3/40 37/379
5,974,706 A * 11/1999 Kaczmarski ..... E02F 3/3622 37/468
6,154,989 A * 12/2000 Kaczmarski ..... E02F 3/3622 37/444
7,066,706 B2 6/2006 Risch
8,015,734 B1 9/2011 Mills
8,695,240 B2 4/2014 Mills
9,139,975 B2 9/2015 Rochel
9,447,561 B2 * 9/2016 Nitti ..... E02F 3/40
2013/0067779 A1 * 3/2013 Mills ..... E02F 3/40 37/444
2017/0016204 A1 * 1/2017 Bandou ..... E02F 3/34

FOREIGN PATENT DOCUMENTS

CA 2456946 A1 * 8/2005 ..... E02F 3/40
WO 2012113542 8/2012

* cited by examiner

*Primary Examiner* — Matthew Troutman
(74) *Attorney, Agent, or Firm* — Jonathan F. Yates

(57) ABSTRACT

An implement system includes a linkage and a bucket coupled with the linkage and movable between a dump position and a racked position. The bucket has a compound back section that forms a profile having a basin shape to assist in distributing material within the back section when the bucket is curled, and nesting the bucket close to the linkage. Related methodology is disclosed.

10 Claims, 4 Drawing Sheets

IMPLEMENT SYSTEM WITH NESTING BUCKET AND IMPLEMENT SYSTEM OPERATING METHOD

TECHNICAL FIELD

The present disclosure relates generally to buckets for capturing and moving material, and more particularly to a bucket back section profiled for distribution of material and nesting of the bucket with a linkage.

BACKGROUND

Wheel loaders, track loaders and other loading machines are equipped with buckets for the purpose of digging, loading and transporting all manner of different materials. Materials in a loose state such as sand, gravel, rock, soil, mulch, salt and still others are commonly moved about a worksite or from a pile into another machine for transport. One application at mine sites is the loading of blasted rock such as ore or overburden into a truck for disposal or transport to a processing site. A loader will typically drive into a pile of material with the bucket at a cutting or digging angle, generally but not always a horizontal bucket orientation, and then commence curling the bucket upon or slightly after entering the pile. The bucket is typically curled back to a racked position, the loader backs out of the pile, and then transports the bucket load to a dump site or into the bed of a truck. The same basic cycle can be repeated many times.

The overall efficiency of the process can vary dependent upon a number of factors, but in general it is desired to execute the capture and dump cycle as quickly as possible and with the bucket as full as possible. There can be tradeoffs in bucket filling versus cycle time that are managed to various ends. Moreover, the type of material and properties of the material or the pile itself such as particle size, moisture content, pile steepness, and still other factors can introduce variation and unpredictability to the manner in which the machine and bucket interact with the pile of material.

Those skilled in the art will be familiar with the wide variety of technologies developed over the years that attempt to improve upon the basic processes of loader operation and construction. Different bucket configurations, materials, and bucket construction techniques have been developed that are tailored to material type and/or loader operating environment, machine or implement system configurations, and other factors. U.S. Pat. No. 8,695,240 to Mills et al. is one example bucket design and entitled Machine Bucket Assembly. Mills et al. propose a bucket having a top section, a bottom section, and a curved middle section, with geometry configured to provide a loadability index within a target range.

SUMMARY OF THE INVENTION

In one aspect, an implement system for a machine includes a linkage, and a bucket for capturing a material, and including mounting elements coupling the bucket to the linkage, and the bucket being movable relative to the linkage between a racked position and a dump position. The bucket further includes a bucket shell having an upper edge, a roof section extending rearward from the upper edge, a lower edge, a floor section extending rearward from the lower edge and being oriented diagonally to the roof section, and a compound back section having the mounting elements located thereon. The roof section has a linear profile, the floor section has a linear profile, and the compound back section has a segmental profile. The segmental profile has a first curved segment transitioning with the linear profile of the roof section, a second curved segment transitioning with the linear profile of the floor section, and a linear middle segment transitioning from the first curved segment to the second curved segment, such that the segmental profile forms a basin shape, to distribute material within the compound back section and nest the bucket with the linkage at the racked position.

In another aspect, a bucket for an implement system in a machine includes a bucket shell having an upper edge, a roof section extending rearward from the upper edge, a lower edge, a floor section extending rearward from the lower edge, and a compound back section connecting between the roof section and the floor section. The bucket further includes a first side wall coupled with the bucket shell and a second side wall coupled with the bucket shell, and each of the upper edge and the lower edge extending between the first side wall and the second side wall. The bucket further includes mounting elements coupled to the compound back section of the bucket shell and structured to couple with a linkage. The roof section and the floor section each have a linear profile, and are oriented diagonally to one another to form a bucket throat, and the compound back section having a segmental profile including a first curved segment transitioning with the linear profile of the roof section, a second curved segment transitioning with the linear profile of the floor section, and a linear middle segment transitioning from the first curved segment to the second curved segment. The bucket is structured to pivot relative to the linkage between a dump position and a racked position, and the segmental profile forms a basin shape, such that material is distributed within the compound back section and the bucket nests with the linkage at the racked position.

In still another aspect, a method of operating an implement system includes capturing material with a bucket coupled to a linkage in the implement system, and tilting the bucket relative to the linkage from a digging position toward a racked position, such that captured material moves under the force of gravity through a throat of the bucket. The method further includes distributing material received from the throat in a compound back section of the bucket toward a first curved segment of the compound back section adjoining the roof section and toward a second curved segment of the compound back section adjoining the floor section. The method still further includes stopping the tilting of the bucket at the racked position such that a linear middle segment of the compound back section is adjacent an upper surface of the linkage and the bucket is nested with the linkage.

DETAILED DESCRIPTION

Figure 1:
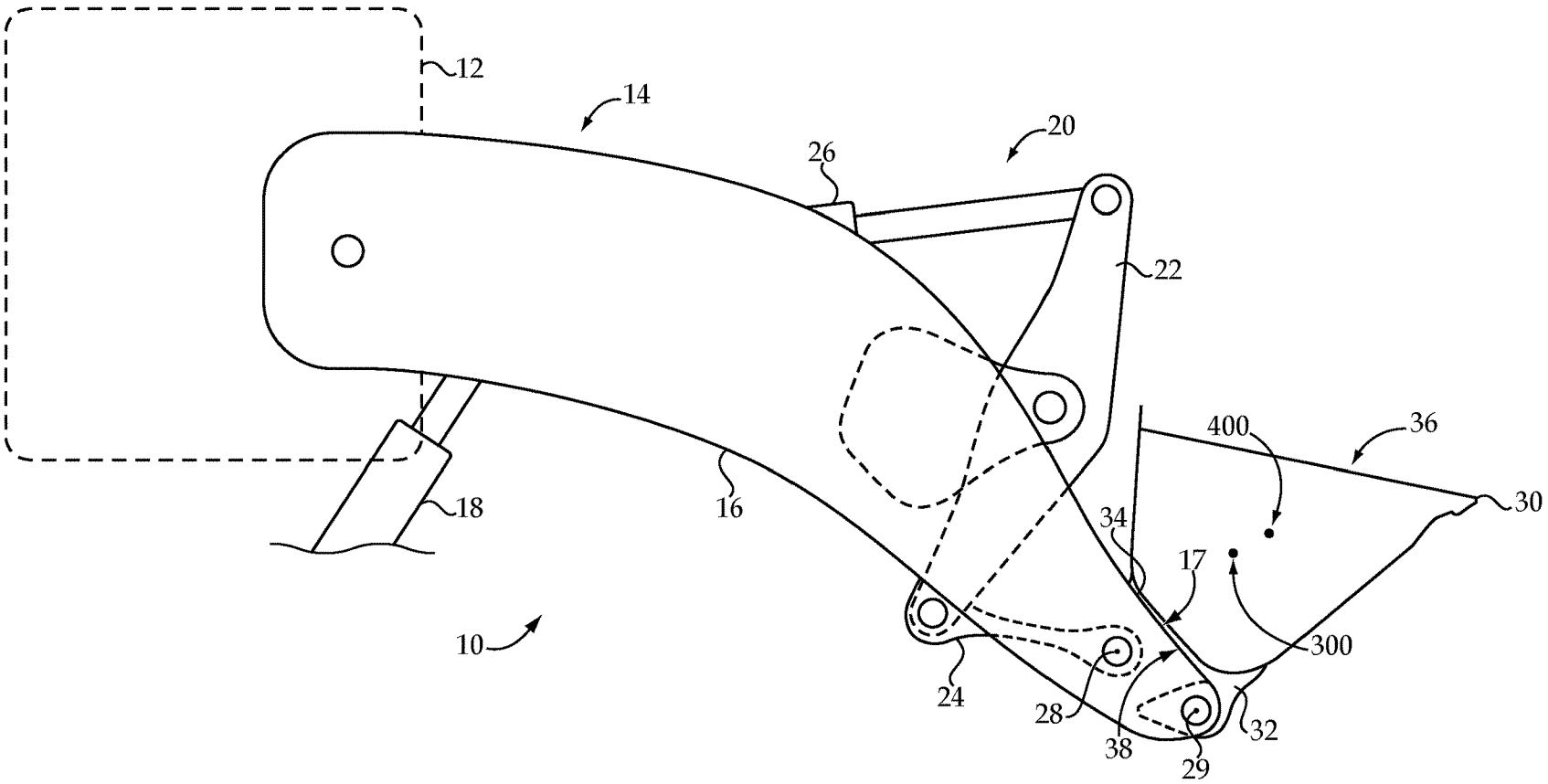
FIG. 1 is a side diagrammatic view of an implement system, according to one embodiment.

Referring to FIG. 1 there is shown an implement system 10 according to one embodiment, and coupled with a machine 12. Machine 12 may include a wheel loader or a track loader, for example, including ground engaging propulsion elements in the nature of wheels or tracks in a conventional manner. It is contemplated that applications where a machine is used to capture and dump loose or moderately cohesive material from a pile will particularly benefit from the teachings set forth herein, however, the present disclosure is not strictly limited to any particular machine configuration or material or work application. Implement system 10 may include a linkage 14 having a lift arm 18 and a tilt lever assembly 20 pivotably coupled with lift arm 18. A bucket 30 including a plurality of mounting elements is pivotably coupled with lift arm 16 at a first location by way of a first one of the mounting elements 32, and defining a pivot axis 29, and at a second location by way of a second one of the mounting elements 34, and defining a pivot axis 28.

A lift actuator 18 is coupled between machine 12 and lift arm 16 and raises and lowers lift arm 16. A tilt actuator 26 is structured to pivot tilt lever 22 between a first position at which a connector 24 coupled with tilt lever 22 pivots bucket 30 toward a dump position, and a second position at which connector 24 pivots bucket 30 toward a curled or racked position, approximately as shown in FIG. 1. Implement system 10 may be operated to capture, lift and dump material, such as loose rock at the toe of a blast zone at a mine, into a truck or the like. Bucket 30 is uniquely configured to advantageously receive material during operation, improving efficiency, and to nest with lift arm 16, as further described herein. Bucket 30 has a front section 36, and a back section 38 shaped so as to enable bucket 30 and thus the material therein to be positioned close to lift arm 16. Back section 38 can be understood as compound, in reference to its shape, and also enables material to be distributed more readily at the back of bucket 30, in turn making it easier in at least some instances for incoming material to enter bucket 30, the significance of which will be further apparent from the following description.

One way the shape of bucket 30 can be characterized in at least certain embodiments is similar to what might be expected if a roughly parabolic-shaped bucket were squeezed down to deform the back section thereof in conformity with a flat surface. Such a shape has the tendency to have a center of gravity lower and closer to the lift arm in a bucket and linkage example similar to the example construction in FIG. 1. In FIG. 1, reference numeral 300 identifies an approximate center of gravity of bucket 30, whereas reference numeral 400 identifies an approximate center of gravity of a known bucket design where the bucket has a shape that is generally parabolic. It can be seen that center of gravity 300 is located lower and closer to lift arm 16 than center of gravity 400. Back section 38 of bucket 30 is positioned adjacent to an upper surface 17 of lift arm 16.

Figure 2:
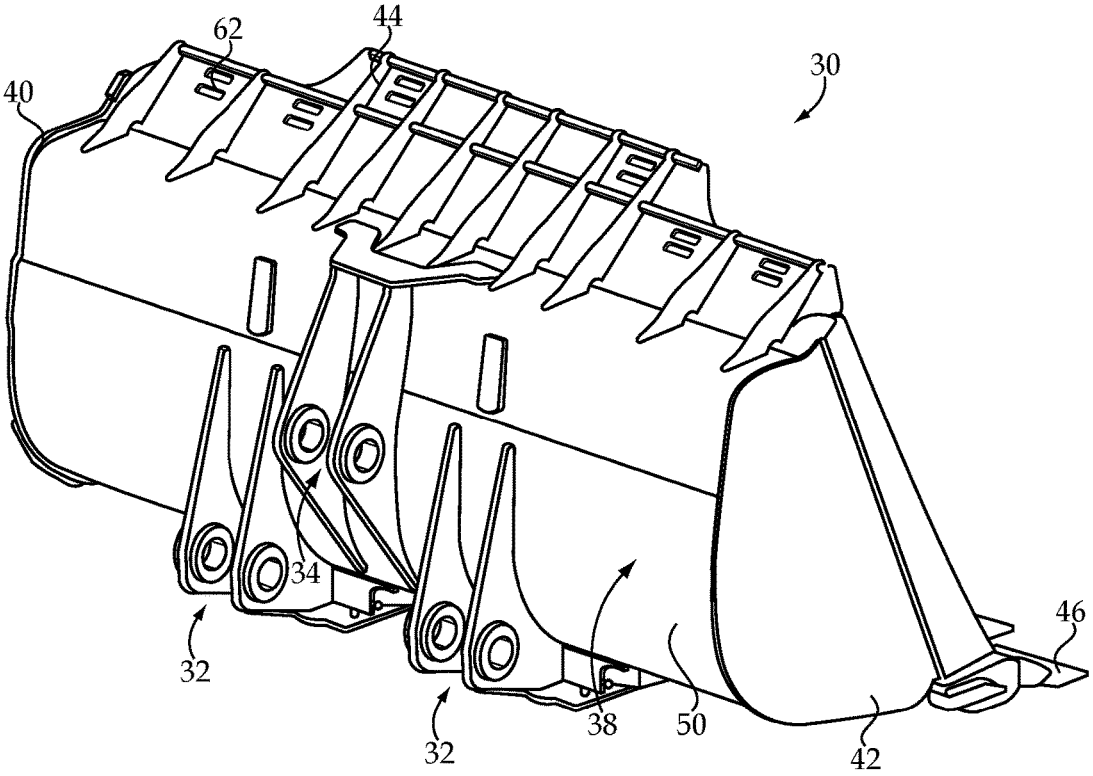
FIG. 2 is a back perspective view of a bucket, according to one embodiment.

Referring now also to FIG. 2, there is shown a perspective view of bucket 30, illustrating back section 38 and also a first side wall 40 and a second side wall 42 coupled to opposite sides of back section 38. Back section 38 is part of a bucket shell 50, to which side walls 40 and 42 are coupled. A rock guard 44 extends upwardly and forwardly of bucket shell 50. Cutting elements 46 also extend forwardly of bucket shell 50. Also shown in FIG. 2 are upper mounting elements 34 positioned at least in part upon back section 38, and lower mounting elements 32 also positioned at least in part upon back section 38. Mounting elements 32 and 34 pivotably couple bucket 30 to linkage 14. Pivot axis 34 may extend through mounting elements 34 whereas pivot axis 29 may extend through one of mounting elements 32. Linkage 14 may be equipped with hooks or the like structured to couple with pins supported within mounting elements 32 and 34 in a generally conventional manner. It should be appreciated that while the side view illustration of FIG. 1 depicts only a single lift arm, in a typical embodiment linkage 14 will include two parallel lift arms, with tilt lever assembly 20 being positioned generally between the parallel lift arms. In other embodiments, a single center lift arm might be used with two outer tilt lever assemblies, or still some other configuration.

Figure 3:
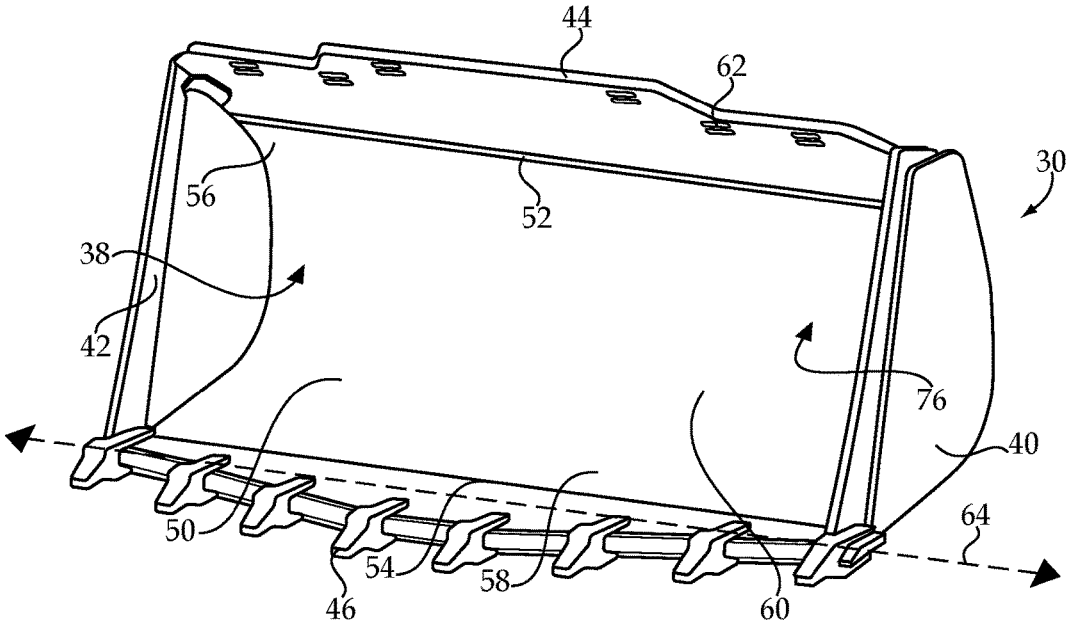
FIG. 3 is a front perspective view of a bucket, according to one embodiment.

Referring also now to FIG. 3, there is shown a view of bucket 30 illustrating certain additional features, including an upper edge 52 of shell 50 that extends between side walls 40 and 42, and a lower edge 54 parallel to upper edge 52 and extending between side walls 40 and 42. Guard 44 is coupled with upper edge 52. A roof section 56 extends rearward from upper edge 52, and a floor section 58 extends rearward from lower edge 54. Floor section 58 and roof section 56 are oriented diagonally to one another so as to form a bucket throat 76. Also shown in FIGS. 2 and 3 is a lower slot 62. Those skilled in the art will be familiar with the lowermost slot 62 and its relation to bucket payload volume calculations and bucket geometry, as further discussed herein. A ⅓ point line 64 is also shown extending across/through cutting elements 46 and also relates to certain geometric attributes of bucket 30, as further discussed herein. It can be seen from FIGS. 2 and 3 that bucket 30 can be understood as having a width dimension extending in parallel with upper edge 52 and lower edge 54, and a height dimension oriented normal to the bucket width dimension that is less than the width dimension. Certain of the geometric parameters to be discussed herein are in reference to an imaginary plane that includes the height dimension and is oriented normal to the width dimension.

As noted above, bucket 30 is shaped for enhanced distribution of material in back section 38 and also for nesting of bucket 30 with linkage 14. To this end, roof section 56 may have a linear profile, floor section 58 may have a linear profile, and compound back section 38 may have a segmental profile. Features having a linear profile will be understood as having the appearance of a substantially straight line considered from at least one perspective. In the present instance, roof section 56 and floor section 58 appear straight and thus have linear profiles when viewed from the side, in other words where one is viewing one of side walls 40 or 42 straight on from a lateral side of bucket 30. A segmental profile can include linear segments, but as a whole does not share this same property of a straight appearance when viewed from the side. Certain additional features and practical implementations of the possible shapes of back section 38 are further discussed below.

Figure 4:
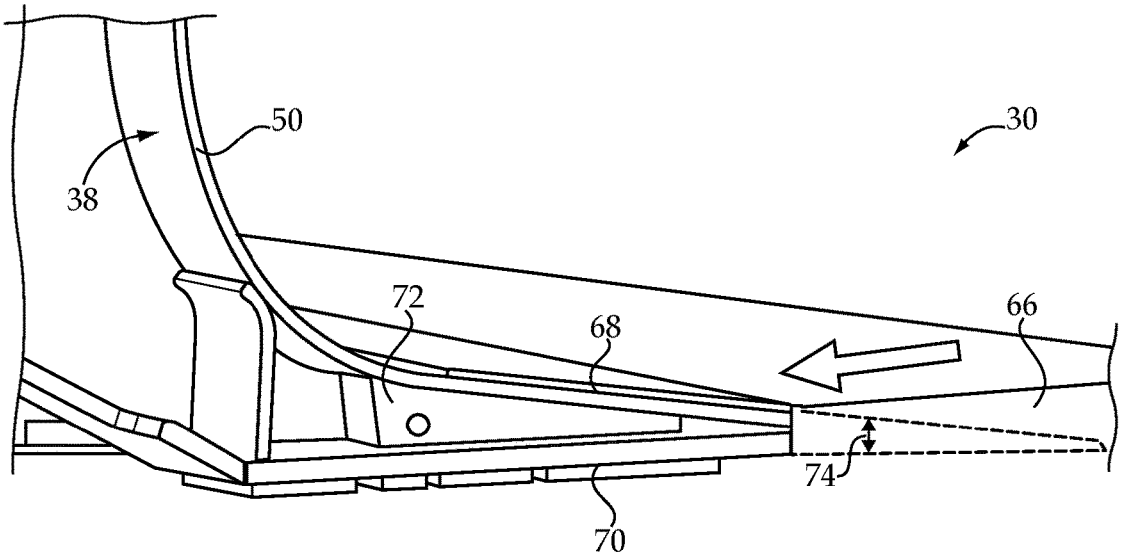
FIG. 4 is a side view of a portion of the bucket of FIGS. 2 and 3.

Referring now also to FIG. 4, there is shown a view of bucket 30 as it might appear where side wall 42 has been removed and an edge (not numbered) of bucket shell 50 is visible. Bucket 30 may include a forward plate 66 extending forward of floor section 58, to which cutting elements 46 are attached but not shown in the FIG. 4 view. Thus, cutting elements 46 are understood to be coupled to lower edge 54 by way of plate 66. A wear plate 68 may be mounted upon bucket shell 50 on an upper side, and a paddle plate 70 is coupled to bucket shell 50 at a location rearward of cutting elements 46 and vertically below floor section 68 and defines a horizontal plane. Wedges 72 are positioned between shell 50 and paddle plate 70 in the illustrated embodiment. Floor section 58 and also wear plate 68 may be oriented at a floor angle 74 relative to the horizontal plane. In FIG. 4 an arrow indicates an approximate direction of material flow that might be observed where bucket 30 impinges upon material in a pile at a neutral, horizontal position. It can be noted that floor angle 74 will result in material striking against floor section 58 at an angle, at least where bucket 30 is oriented with paddle plate 70 horizontal to an underlying ground surface. This feature contrasts with certain known bucket designs where a bucket floor and/or other features of the bucket were designed so that a bucket would more typically enter a pile with the floor horizontal.

Figure 5:
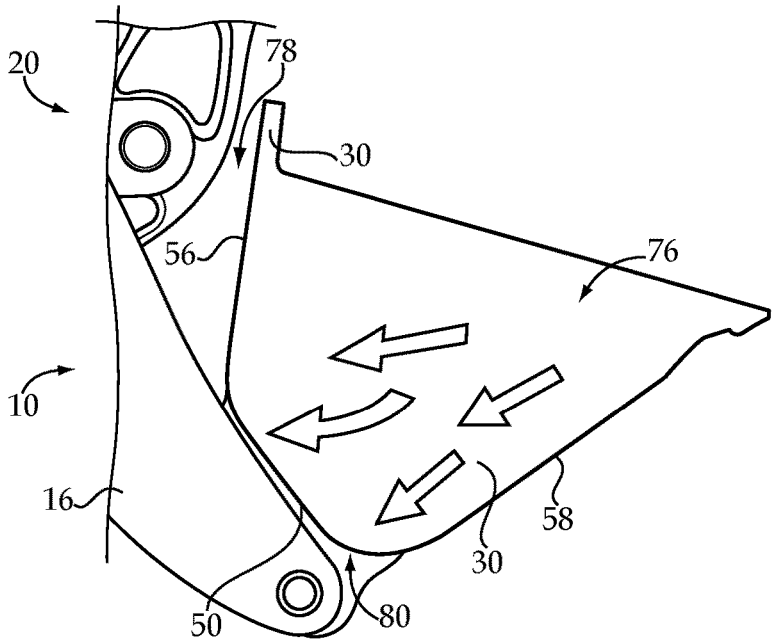
FIG. 5 is a side diagrammatic view of a portion of an implement system, according to one embodiment.

Referring now also to FIG. 5, there is shown a side view of implement system 10 shown as it might appear where bucket 30 has been curled back to a racked position to capture material that has been dug from a pile, bank or the like. Back section 38 is positioned adjacent to lift arm 16 at the racked position. It will be recalled that back section 30 of bucket 30 is expanded relative to certain known designs, and according to geometric attributes still to be described herein. In general, the expanded back section can be understood to have a segmental profile that forms a basin shape, to distribute material within back section 38 and nest bucket 30 with linkage 20 at the racked position. In FIG. 5, arrows are shown illustrating an example tumbling flow of material such that the material is distributed toward roof section 56 and floor section 58. It is believed that deconcentrating the volume of bucket 30 at back section 38 makes it easier for material to move out of the way as additional material is received in back section 38 from throat 76 during curling bucket 30. The basin shape is considered to facilitate this general flow of material better than a parabolic shaped bucket. In a parabolic shaped bucket, material tumbling into the bucket may have a greater tendency to collide with other material and resist distribution within the back section of the bucket.

Regarding the nesting of bucket 30, it can be seen from FIG. 5 that a first space 78 extends generally between bucket 30 and tilt lever assembly 20. Another space 80 extends generally between bucket 30 and lift arm 16. In certain earlier designs, spaces analogous to spaces 78 and 80 could be expected to be relatively larger as the different volume distributions of the bucket positioned the bucket center of gravity higher and more forward. The nesting of bucket 30 with linkage 14 enables the mass of material to be carried relatively closer to an associated machine, and can be expected to be associated with reduced strain on certain components and reduced wear, notably with respect to the tires. Many loader machines can operate a substantial portion of their service life carrying bucket loads and, accordingly, shifting load and bucket mass more towards the machine center of gravity can be expected to alter the weight distribution of the machine so as to cause significantly less intensive wear on the front tires.

Figure 6:
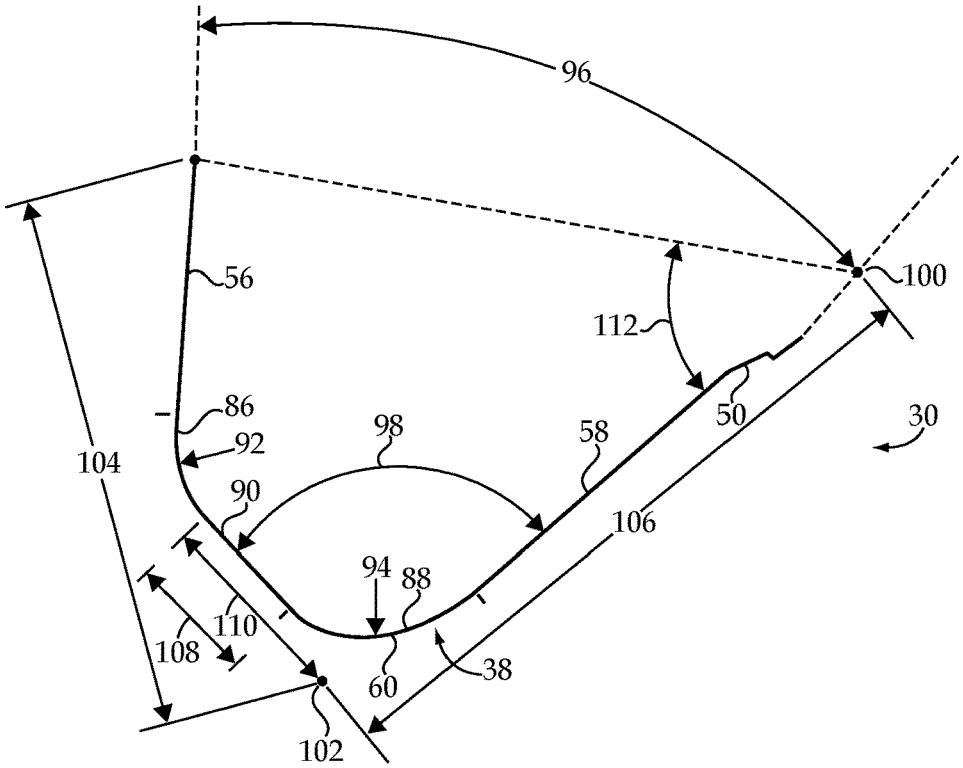
FIG. 6 is a side diagrammatic view of a bucket profile, according to one embodiment.

As noted above, certain practical implementations have been developed relating to example specifications for various geometric features of bucket 30. Referring also now to FIG. 6, there can be seen a first curved segment 86 of the segmental profile of back section 36, the first curved segment 86 transitioning with the linear profile of roof section 56. A second curved segment 88 transitions with the linear profile of floor section 58. A linear middle segment 90 transitions from first curved segment 86 to second curved segment 88, such that the segmental profile forms a basin shape. A basin shape can be understood herein to be wide and shallow, with curved walls and a generally flat floor. One of the walls might be higher or steeper than the other. Linear middle segment 90 may be oriented perpendicular to the linear profile of bucket floor 58 in certain embodiments, although in others a flat angle 98 formed between those segments might be relatively steeper or shallower, such as from about 60 degrees to about 130 degrees. The flat angle 98 will most typically be about 90 degrees or greater. Floor angle 74 shown in FIG. 4 may be greater than zero, and in a further practical implementation strategy may be about 20 degrees or less. In still further instances floor angle 74 may be about 9 degrees or less. A first radius of curvature 92 defined by curved segment 86 may be different from a second radius of curvature 94 defined by curved segment 88. Radius 92 will typically, but not necessarily, be less than radius 94. A ratio of radius 92 to 94 may be from about 0.5 to about 1.5. Each of radiuses 92 and 94 may be defined in the imaginary plane mentioned above that includes the plane of the page in FIG. 6. A running length of curved segment 86 may be less than running lengths of each of curved segment 88 and middle segment 90.

Bucket 30 may also have a setback configuration such that upper edge 52 is located rearward of lower edge 54. In the embodiment illustrated in FIG. 6, a setback angle 112 may be about 90 degrees or less, and may be from about 55 degrees to about 90 degrees. A throat angle 96 may be from about 5 degrees to about 60 degrees. Setback angle 112 may be greater than throat angle 96 by a factor of about 1.5 or less. Embodiments are contemplated where setback angle 112 is about 60 degrees, and where throat angle 96 is about 40 degrees. Bucket 30 may further define a B-pin to ⅓ point dimension 106 and a B-pin to slot dimension 104. In FIG. 6 the B-pin location is shown via reference numeral 102. The ⅓ point is shown via reference numeral 100. A ratio of dimension 106 to dimension 104 may be from about 0.9 to about 1.4. A flat length dimension 108 is shown in FIG. 6, and a ratio of dimension 108 to radius 94 may be from about 0.25 to about 2.0. A flat height dimension 110 is also shown. Flat height dimension 110 may be about twice dimension 108, or greater.

INDUSTRIAL APPLICABILITY

Referring to the drawings generally, in a typical operation machine 12 may be operated to drive into a pile of material with bucket 30 held at a generally horizontal digging position. Implement system 10 may be operated such that bucket 30 is tilted relative to linkage 14 from a digging position toward a racked position, such that captured material moves under the force of gravity through throat 76. Material received from throat 76 can be distributed toward first curved segment 86 adjoining roof section 56 and toward second curved segment 88 adjoining floor section 58. As described herein, greater ease of material falling and/or sliding out of the way is believed to make it easier for additional material to move through throat 76 and thus to enter and fill bucket 30. As bucket 30 completes tilting and is stopped at the racked position, back section 38 will be positioned adjacent to linkage 14 and in particular lift arm 16 such that bucket 30 nests with linkage 14.

These general principles of implement system operation and material flow can improve operation compared to known strategies, and in particular with regard to fill factor, generally defined as effective payload versus calculated and theoretical payload. Improved fill factor is associated with generally greater productivity, as each capture, lift and dump cycle of machine 12 moves a greater quantity of material. Moreover, the changed center of gravity as compared with other known bucket designs can reduce tire wear or wear on other components, and in some instances increase machine stability. A relatively shorter length of bucket floor 58 can provide a relatively greater breakout force, providing greater ease in breaking a load of material away from a pile and thus loading bucket 30 more rapidly.

Figure 7:
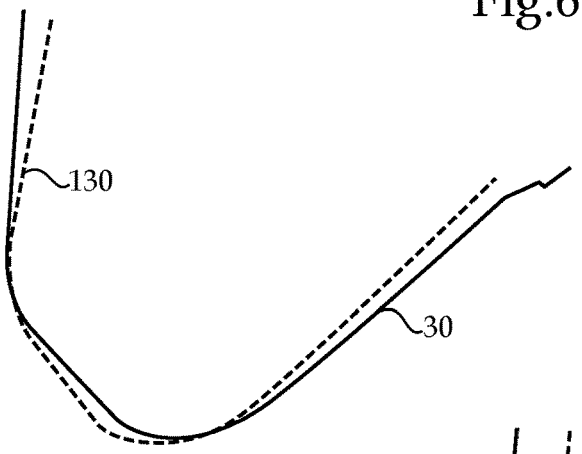
FIG. 7 is a side diagrammatic view of the bucket profile of FIG. 6 in comparison to one known design.
Figure 8:
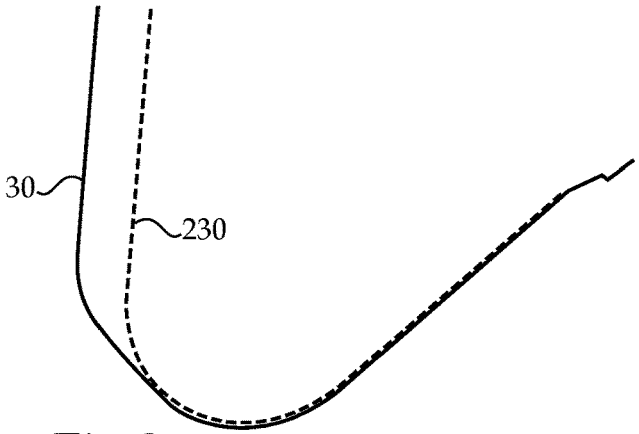
FIG. 8 is a side diagrammatic view of the bucket profile of FIG. 6 in comparison to another known design.

Referring now to FIG. 7, there is shown a profile of bucket 30 in comparison with one known bucket design 130 having a back section with a profile that is different from a basin shape as in the present disclosure. In the known bucket 130, rather than a wide and shallow profile with a generally flat floor, a trough is observed. While bucket 130 could perhaps have advantages in certain applications, it is likely the bucket 130 would be inferior with regard to distribution of material within its back section. Moreover, the trough shape in the profile of bucket 130 would likely be more labor intensive to manufacture, and would likely also prevent nesting of bucket 130 in the manner and to the extent to which bucket 30 is able to nest with linkage 14. In FIG. 8, there is shown a profile of bucket 30 in comparison with another known bucket design 230 having a back section with a generally parabolic profile. As discussed herein, a parabolic profile can be expected to be inferior at least with regard to nesting of bucket 230 with a linkage, and also the distribution of material toward the back section of bucket 230 during curling to a racked position.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A bucket for an implement system in a machine comprising:

a bucket shell including an upper edge, a roof section extending rearward from the upper edge, a lower edge, a floor section extending rearward from the lower edge, and a compound back section connecting between the roof section and the floor section;

a first side wall coupled with the bucket shell and a second side wall coupled with the bucket shell, and each of the upper edge and the lower edge extending between the first side wall and the second side wall;

a paddle plate coupled with the bucket shell at a location vertically below the floor section;

mounting elements coupled to the compound back section of the bucket shell and structured to couple with a linkage, wherein the mounting elements include a first mounting element and a second mounting element defining a first pivot axis and a second pivot axis, respectively;

the roof section and the floor section each having a linear profile, and being oriented diagonally to one another to form a bucket throat having a throat angle extending between the roof section and the floor section, the throat angle being about 40 degrees;

the compound back section having a segmental profile including a first curved segment transitioning with the linear profile of the roof section and defining a first radius of curvature, a second curved segment transitioning with the linear profile of the floor section and defining a second radius of curvature, and a linear middle segment transitioning from the first curved segment to the second curved segment;

the bucket being structured to pivot about the first pivot axis and the second pivot axis relative to the linkage between a dump position and a racked position, and the segmental profile forming a basin shape, such that material is distributed within the compound back section and the bucket nests with the linkage at the racked position;

the floor section being oriented diagonally to the paddle plate at a floor angle greater than zero, the floor section further defining a bucket floor direction, and the linear middle segment being oriented perpendicular to the linear profile of the bucket floor and defining a perpendicular direction; and the linear middle segment forming a floor of the basin shape, and the first curved segment and the second curved segment forming walls of the basin shape, and wherein the first pivot axis is between endpoints of the linear middle segment, in the perpendicular direction, and the second pivot axis is between endpoints of the second curved segment, in the perpendicular direction.

2. The bucket of claim 1 further comprising a guard coupled with the upper edge, cutting elements coupled with the lower edge, wherein the paddle plate is coupled with the bucket shell at a location rearward of the cutting elements.

3. The bucket of claim 2 wherein the bucket defines a setback angle of about 90 degrees or less.

4. The bucket of claim 3 wherein the floor angle is about 20 degrees or less.

5. The bucket of claim 4 wherein the floor angle is about 9 degrees, and the setback angle is about 60 degrees.

6. The bucket of claim 1 wherein the first curved segment defines a first radius of curvature and the second curved segment defines a second radius of curvature different from the first radius of curvature.

7. The bucket of claim 6 wherein a ratio of the first radius to the second radius is from about 0.5:1.0 to about 1.5:1.0.

8. The bucket of claim 7 wherein the first and the second mounting elements include an upper mounting element and a lower mounting element, respectively, and further comprising a guard extending from the upper edge.

9. The bucket of claim 4 wherein the first radius of curvature is less than the second radius of curvature.

10. The bucket of claim 4 wherein a running length of the first curved segment is less than running lengths of each of the second curved segment and the middle segment.

* * * * *